US011450295B2

(12) United States Patent
Lyu et al.

(10) Patent No.: US 11,450,295 B2
(45) Date of Patent: Sep. 20, 2022

(54) CHARGE COMPENSATION CIRCUIT, CHARGE COMPENSATION METHOD, AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Wenxu Lyu, Beijing (CN); Xinqiu Wang, Beijing (CN); Xue Dong, Beijing (CN); Ming Chen, Beijing (CN); Wei Sun, Beijing (CN); Hsinchung Lo, Beijing (CN)

(73) Assignees: Beijing BOE Display Technology Co., Ltd., Beijing (CN); Beijing BOE Technology Development Co., Ltd., Beijing (CN)

( * ) Notice: Subject to any disclaimer, the term of this patent is extended or adjusted under 35 U.S.C. 154(b) by 333 days.

(21) Appl. No.: 16/537,962

(22) Filed: Aug. 12, 2019

(65) Prior Publication Data

US 2020/0273422 A1 Aug. 27, 2020

(30) Foreign Application Priority Data

Feb. 21, 2019 (CN) ..... 201910129059.3

(51) Int. Cl.
*G09G 3/36* (2006.01)

(52) U.S. Cl.
CPC ..... *G09G 3/3696* (2013.01); *G09G 3/3685* (2013.01); *G09G 2320/0223* (2013.01); *G09G 2340/06* (2013.01)

(58) Field of Classification Search
CPC ..... G09G 3/3696; G09G 3/3685; G09G 2320/0223; G09G 2340/0464; G09G 2340/06
See application file for complete search history.

(56) References Cited

U.S. PATENT DOCUMENTS

2002/0163490 A1* 11/2002 Nose ..... G09G 3/3696 345/89
2011/0063337 A1* 3/2011 Lin ..... G09G 3/3648 345/690
2014/0104262 A1* 4/2014 Miyake ..... G09G 3/3696 345/212

* cited by examiner

*Primary Examiner* — William Boddie
*Assistant Examiner* — Saifeldin E Elnafia
(74) *Attorney, Agent, or Firm* — Brooks Kushman P.C.

(57) ABSTRACT

A charge compensation circuit of the present disclosure includes: a sorting sub-circuit, configured to sort inputted initial data voltages according to a pixel structure type to obtain a plurality of channels of data, each channel of the data including initial data voltages corresponding to all data lines when a gate line in a row corresponding to the channel is turned on; a storage comparison sub-circuit, configured to output many sets of comparison data according to the stored data; a lookup sub-circuit, configured to look up actual compensation data corresponding to the set of comparison data; and a compensation sub-circuit, configured to compensate for the initial data voltage on a data line corresponding to the actual compensation data when the gate line in the current row is turned on, to obtain an actual data voltage on the data line when the gate line in the current row is turned on.

14 Claims, 7 Drawing Sheets

--Prior Art--

--Prior Art--

| | Data1 | Data2 | Data3 | Data4 | Data5 | Data6 | Data7 | Data8 | Data9 | Data10 | Data11 | Data12 | Data13 | Data14 | Data15 | Data16 |
|---|---|---|---|---|---|---|---|---|---|---|---|---|---|---|---|---|
| Gate1 | R0 | B0 | G1 | R2 | B2 | G3 | R4 | B4 | G5 | R6 | B6 | G7 | R8 | B8 | G9 | R10 |
| Gate2 | G0 | R1 | B1 | G2 | R3 | B3 | G4 | R5 | B5 | G6 | R7 | B7 | G8 | R9 | B9 | G10 |
| Gate3 | R0 | B0 | G1 | R2 | B2 | G3 | R4 | B4 | G5 | R6 | B6 | G7 | R8 | B8 | G9 | R10 |
| Gate4 | G0 | R1 | B1 | G2 | R3 | B3 | G4 | R5 | B5 | G6 | R7 | B7 | G8 | R9 | B9 | G10 |
| Gate5 | R0 | B0 | G1 | R2 | B2 | G3 | R4 | B4 | G5 | R6 | B6 | G7 | R8 | B8 | G9 | R10 |
| Gate6 | G0 | R1 | B1 | G2 | R3 | B3 | G4 | R5 | B5 | G6 | R7 | B7 | G8 | R9 | B9 | G10 |
| Gate7 | R0 | B0 | G1 | R2 | B2 | G3 | R4 | B4 | G5 | R6 | B6 | G7 | R8 | B8 | G9 | R10 |
| Gate8 | G0 | R1 | B1 | G2 | R3 | B3 | G4 | R5 | B5 | G6 | R7 | B7 | G8 | R9 | B9 | G10 |

Gn-1

| Gn \ A0 | 0 | 8 | 16 | 24 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 1 | 1 | 1 | 1 | 2 | 2 | 2 | 4 | 5 | 7 | 8 | 10 | 11 | 12 |
| 16 | 0 | 0 | 0 | 0 | 1 | 1 | 2 | 2 | 3 | 3 | 4 | 4 | 5 | 8 | 11 | 14 | 17 | 20 | 22 |
| 24 | 0 | 0 | 0 | 0 | 0 | 1 | 1 | 2 | 3 | 4 | 4 | 5 | 6 | 7 | 12 | 16 | 21 | 25 | 29 |
| 32 | 4 | 4 | 2 | 0 | 0 | 0 | 1 | 2 | 3 | 4 | 5 | 6 | 7 | 8 | 10 | 16 | 22 | 28 | 33 |
| 48 | 16 | 12 | 9 | 6 | 0 | 0 | 1 | 2 | 3 | 4 | 6 | 7 | 9 | 10 | 12 | 15 | 24 | 33 | 42 |
| 64 | 20 | 16 | 12 | 8 | 4 | 1 | 0 | 1 | 2 | 4 | 6 | 8 | 10 | 12 | 14 | 16 | 20 | 32 | 44 |
| 80 | 28 | 20 | 16 | 12 | 8 | 4 | 1 | 0 | 1 | 2 | 3 | 4 | 6 | 8 | 14 | 20 | 29 | 38 | 46 |
| 96 | 32 | 24 | 20 | 16 | 12 | 8 | 4 | 1 | 0 | 2 | 4 | 6 | 9 | 12 | 14 | 18 | 24 | 32 | 44 |
| 112 | 40 | 28 | 24 | 20 | 16 | 12 | 8 | 4 | 2 | 0 | 1 | 2 | 4 | 8 | 12 | 20 | 24 | 28 | 36 |
| 128 | 40 | 32 | 28 | 24 | 20 | 16 | 12 | 8 | 6 | 1 | 0 | 2 | 4 | 8 | 12 | 16 | 20 | 28 | 48 |
| 144 | 40 | 32 | 28 | 24 | 20 | 16 | 14 | 12 | 8 | 4 | 2 | 0 | 1 | 2 | 4 | 12 | 16 | 24 | 44 |
| 160 | 40 | 32 | 28 | 24 | 20 | 16 | 14 | 12 | 10 | 8 | 4 | 1 | 0 | 2 | 4 | 10 | 16 | 20 | 38 |
| 176 | 40 | 32 | 28 | 26 | 24 | 20 | 16 | 14 | 12 | 10 | 8 | 4 | 2 | 0 | 2 | 4 | 12 | 16 | 36 |
| 192 | 36 | 32 | 28 | 24 | 22 | 20 | 16 | 14 | 13 | 12 | 10 | 8 | 4 | 2 | 0 | 4 | 12 | 18 | 24 |
| 208 | 32 | 28 | 26 | 24 | 22 | 20 | 16 | 14 | 12 | 10 | 9 | 8 | 6 | 5 | 4 | 0 | 2 | 13 | 20 |
| 224 | 28 | 24 | 22 | 20 | 19 | 17 | 16 | 14 | 13 | 12 | 11 | 10 | 9 | 8 | 4 | 2 | 0 | 2 | 12 |
| 240 | 20 | 20 | 18 | 17 | 16 | 14 | 13 | 12 | 11 | 10 | 9 | 8 | 8 | 6 | 5 | 4 | 2 | 0 | 0 |
| 255 | 0 | 0 | 0 | 0 | 0 | 0 | 0 | 0 | 0 | 0 | 0 | 0 | 0 | 0 | 0 | 0 | 0 | 0 | 0 |

FIG. 7

| | 0 | 320 | 640 | 960 | 1280 | 1600 | 1920 | 2240 | 2560 | 2880 | 3200 | 3520 | 3839 |
|---|---|---|---|---|---|---|---|---|---|---|---|---|---|
| 0 | 1.68 | 1.53 | 1.38 | 1.32 | 1.27 | 1.22 | 1.19 | 1.22 | 1.27 | 1.32 | 1.38 | 1.53 | 1.68 |
| 270 | 1.60 | 1.47 | 1.34 | 1.26 | 1.22 | 1.18 | 1.13 | 1.18 | 1.22 | 1.26 | 1.34 | 1.47 | 1.60 |
| 540 | 1.50 | 1.41 | 1.31 | 1.26 | 1.22 | 1.17 | 1.06 | 1.17 | 1.22 | 1.26 | 1.31 | 1.41 | 1.50 |
| 810 | 1.39 | 1.27 | 1.16 | 1.12 | 1.08 | 1.05 | 1.00 | 1.05 | 1.08 | 1.12 | 1.16 | 1.27 | 1.39 |
| 1080 | 1.27 | 1.18 | 1.08 | 1.01 | 0.99 | 0.95 | 0.92 | 0.95 | 0.99 | 1.01 | 1.08 | 1.18 | 1.27 |
| 1350 | 1.09 | 1.00 | 0.91 | 0.84 | 0.80 | 0.79 | 0.76 | 0.79 | 0.80 | 0.84 | 0.91 | 1.00 | 1.09 |
| 1620 | 1.01 | 0.91 | 0.81 | 0.76 | 0.70 | 0.70 | 0.68 | 0.70 | 0.70 | 0.76 | 0.81 | 0.91 | 1.01 |
| 1890 | 0.92 | 0.81 | 0.71 | 0.67 | 0.60 | 0.62 | 0.59 | 0.62 | 0.60 | 0.67 | 0.71 | 0.81 | 0.92 |
| 2159 | 0.84 | 0.72 | 0.61 | 0.59 | 0.50 | 0.54 | 0.51 | 0.54 | 0.50 | 0.59 | 0.61 | 0.72 | 0.84 |

FIG. 8

CHARGE COMPENSATION CIRCUIT, CHARGE COMPENSATION METHOD, AND DISPLAY DEVICE

CROSS-REFERENCE TO RELATED APPLICATION

This application claims priority to Chinese Patent Application No. 201910129059.3 filed on Feb. 21, 2019, which is incorporated herein by reference in its entirety.

TECHNICAL FIELD

The present disclosure relates to the field of display technology, in particular to a charge compensation circuit, a charge compensation method, and a display device.

BACKGROUND

In large-sized liquid crystal panels of more than 65 inches and some other large-sized panels with poor driving capacity, signal lines of driving circuits are too long and it is difficult for trace impedance to be uniform across the panels. Therefore, there will be insufficient local charging of the panels. The most intuitive reaction in this case is a fine pitch phenomenon, that is, horizontal and vertical textures appear when the panel screen displays a solid color picture, and shapes of the textures are related to pixel structures.

In order to effectively solve the problem of the fine pitch, related art proposes a row-level charge compensation sub-circuit to solve such problems, but the existing charge compensation sub-circuits can enable only a specific pixel structure, rather than all pixel structures, to be subjected to charge compensation, and no specific compensation method is given so far.

SUMMARY

In a first aspect, embodiments of the present disclosure provide a charge compensation circuit, which is applied to a display device and which includes: a sorting sub-circuit, configured to sort inputted initial data voltages according to a pixel structure type of the display device to obtain a plurality of channels of data, each channel of the data including initial data voltages corresponding to all data lines when a gate line in a row corresponding to the channel is turned on; a storage comparison sub-circuit, configured to store the sorted data and output a plurality of sets of comparison data according to the stored data, each set of the comparison data including an actual data voltage on a data line when a gate line in a row immediately preceding a current row is turned on, and an initial data voltage on the same data line when the gate line in the current row is turned on; a lookup sub-circuit, configured to look up, based on each of the sets of comparison data, actual compensation data corresponding to the set of comparison data; and a compensation sub-circuit, configured to compensate for, based on the actual compensation data, the initial data voltage on a data line corresponding to the actual compensation data when the gate line in the current row is turned on, to obtain an actual data voltage on the data line when the gate line in the current row is turned on, wherein the storage comparison sub-circuit is further configured to store the actual data voltages on all the data lines when the gate line in the current row is turned on.

In accordance with some possible embodiments of the present disclosure, the sorting sub-circuit includes a pixel structure type acquiring sub-circuit, configured to acquire a pixel structure type of the display device.

In accordance with some possible embodiments of the present disclosure, the storage comparison sub-circuit includes: a first storage sub-circuit, configured to store initial data voltages on all the data lines when the gate line in the row immediately preceding the current row is turned on; a second storage sub-circuit, configured to store actual data voltages on all the data lines when the gate line in the row immediately preceding the current row is turned on; a third storage sub-circuit, configured to store initial data voltages on all the data lines when the gate line in the current row is turned on; and a fourth storage sub-circuit, configured to store actual data voltages on all the data lines when the gate line in the current row is turned on.

In accordance with some possible embodiments of the present disclosure, the storage comparison sub-circuit further includes a sorting sub-circuit configured to sort the data stored in the storage comparison sub-circuit and output a plurality of sets of comparison data.

In accordance with some possible embodiments of the present disclosure, the lookup sub-circuit includes: a compensation initial data lookup sub-circuit, configured to look up, based on each of the sets of comparison data, initial compensation data corresponding to the set of comparison data in a compensation initial data lookup table; a gain lookup sub-circuit, configured to look up, based on each of the sets of comparison data, a compensation gain corresponding to the set of comparison data in a gain lookup table; and a calculation sub-circuit, configured to calculate the actual compensation data based on the initial compensation data and the compensation gain.

In accordance with some possible embodiments of the present disclosure, the compensation initial data lookup sub-circuit is further configured to determine an initial compensation data c corresponding to comparison data (a, b) according to the following formulas:

$$f(R1) = \frac{x\ (s+1) - a}{x\ (s+1) - xs} f(Q11) + \frac{a - xs}{x\ (s+1) - xs} f(Q21)$$

$$f(R2) = \frac{x\ (s+1) - a}{x\ (s+1) - xs} f(Q12) + \frac{a - xs}{x\ (s+1) - xs} f(Q22)$$

$$f(p) = \frac{y\ (r+1) - b}{y\ (r+1) - yr} f(R1) + \frac{b - yr}{y\ (r+1) - yr} f(R2)$$

where the comparison data (a, b) has a corresponding coordinate point in the compensation initial data lookup table, which is located in a region defined by coordinate points (xs, yr), (xs, y(r+1)), (x(s+1), yr), (x(s+1), y(r+1)); f(Q11) is a value corresponding to the coordinate point (xs, yr) in the compensation initial data lookup table, f(Q12) is a value corresponding to the coordinate point (xs, y(r+1)) in the compensation initial data lookup table, f(Q21) is a value corresponding to the coordinate point (x(s+1), yr) in the compensation initial data lookup table, and f(Q22) is a value corresponding to the coordinate point (x(s+1), y(r+1)) in the compensation initial data lookup table; and a value of f(p) is c.

In accordance with some possible embodiments of the present disclosure, the gain lookup sub-circuit is further configured to calculate a compensation gain corresponding to the comparison data (a, b) by using the following formulas:

$$f(G1)=\frac{e2-e}{e2-e1}f(G11)+\frac{e-e1}{e2-e1}f(G21)$$

$$f(G2)=\frac{e2-e}{e2-e1}f(G12)+\frac{e-e1}{e2-e1}f(G22)$$

$$f(G)=\frac{f2-f}{f2-f1}f(G1)+\frac{f-f1}{f2-f1}f(G2)$$

where a pixel coordinate of a sub-pixel corresponding to the comparison data (a, b) is (e, f), which is located in a region defined by coordinate points (e1, f1), (e1, f2), (e2, f1), and (e2, f2); f(G11) is a compensation gain corresponding to the coordinate point (e1, f1), f(G12) is a compensation gain corresponding to the coordinate point (e1, f2), f(G21) is a compensation gain corresponding to the coordinate point (e2, f1), and f(G22) is a compensation gain corresponding to the coordinate point (e2, f2); and f(G) is g.

In a second aspect, embodiments of the present disclosure further provide a display device, including a charge compensation circuit that is applied to a display device. The charge compensation circuit includes: a sorting sub-circuit, configured to sort inputted initial data voltages according to a pixel structure type of the display device to obtain a plurality of channels of data, each channel of the data including initial data voltages corresponding to all data lines when a gate line in a row corresponding to the channel is turned on; a storage comparison sub-circuit, configured to store the sorted data and output a plurality of sets of comparison data according to the stored data, each set of the comparison data including an actual data voltage on a data line when a gate line in a row immediately preceding a current row is turned on, and an initial data voltage on the same data line when the gate line in the current row is turned on; a lookup sub-circuit, configured to look up, based on each of the sets of comparison data, actual compensation data corresponding to the set of comparison data; and a compensation sub-circuit, configured to, based on the actual compensation data, compensate for the initial data voltage on a data line corresponding to the actual compensation data when the gate line in the current row is turned on, to obtain an actual data voltage on the data line when the gate line in the current row is turned on, wherein the storage comparison sub-circuit is further configured to store the actual data voltages on all the data lines when the gate line in the current row is turned on.

In accordance with some possible embodiments of the present disclosure, the sorting sub-circuit includes a pixel structure type acquiring sub-circuit, configured to acquire a pixel structure type of the display device.

In accordance with some possible embodiments of the present disclosure, the storage comparison sub-circuit includes: a first storage sub-circuit, configured to store initial data voltages on all the data lines when the gate line in the row immediately preceding the current row is turned on; a second storage sub-circuit, configured to store actual data voltages on all the data lines when the gate line in the row immediately preceding the current row is turned on; a third storage sub-circuit, configured to store initial data voltages on all the data lines when the gate line in the current row is turned on; and a fourth storage sub-circuit, configured to store actual data voltages on all the data lines when the gate line in the current row is turned on.

In accordance with some possible embodiments of the present disclosure, the storage comparison sub-circuit further includes a sorting sub-circuit configured to sort the data stored in the storage comparison sub-circuit and output a plurality of sets of comparison data.

In accordance with some possible embodiments of the present disclosure, the lookup sub-circuit includes: a compensation initial data lookup sub-circuit, configured to look up, based on each of the sets of comparison data, initial compensation data corresponding to the set of comparison data in a compensation initial data lookup table; a gain lookup sub-circuit, configured to look up, based on each of the sets of comparison data, a compensation gain corresponding to the set of comparison data in a gain lookup table; and a calculation sub-circuit, configured to calculate the actual compensation data based on the initial compensation data and the compensation gain.

In accordance with some possible embodiments of the present disclosure, the compensation initial data lookup sub-circuit is further configured to determine an initial compensation data c corresponding to comparison data (a, b) according to the following formulas:

$$f(R1)=\frac{x\ (s+1)-a}{x\ (s+1)-xs}f(Q11)+\frac{a-xs}{x\ (s+1)-xs}f(Q21)$$

$$f(R2)=\frac{x\ (s+1)-a}{x\ (s+1)-xs}f(Q12)+\frac{a-xs}{x\ (s+1)-xs}f(Q22)$$

$$f(p)=\frac{y\ (r+1)-b}{y\ (r+1)-yr}f(R1)+\frac{b-yr}{y\ (r+1)-yr}f(R2)$$

where the comparison data (a, b) has a corresponding coordinate point in the compensation initial data lookup table, which is located in a region defined by coordinate points (xs, yr), (xs, y(r+1)), (x(s+1), yr), (x(s+1), y(r+1)); f(Q11) is a value corresponding to the coordinate point (xs, yr) in the compensation initial data lookup table, f(Q12) is a value corresponding to the coordinate point (xs, y(r+1)) in the compensation initial data lookup table, f(Q21) is a value corresponding to the coordinate point (x(s+1), yr) in the compensation initial data lookup table, and f(Q22) is a value corresponding to the coordinate point (x(s+1), y(r+1)) in the compensation initial data lookup table; and a value of f(p) is c.

In accordance with some possible embodiments of the present disclosure, the gain lookup sub-circuit is further configured to calculate a compensation gain corresponding to the comparison data (a, b) by using the following formulas:

$$f(G1)=\frac{e2-e}{e2-e1}f(G11)+\frac{e-e1}{e2-e1}f(G21)$$

$$f(G2)=\frac{e2-e}{e2-e1}f(G12)+\frac{e-e1}{e2-e1}f(G22)$$

$$f(G)=\frac{f2-f}{f2-f1}f(G1)+\frac{f-f1}{f2-f1}f(G2)$$

where a pixel coordinate of a sub-pixel corresponding to the comparison data (a, b) is (e, f), which is located in a region defined by coordinate points (e1, f1), (e1, f2), (e2, f1), and (e2, f2); f(G11) is a compensation gain corresponding to the coordinate point (e1, f1), f(G12) is a compensation gain corresponding to the coordinate point (e1, f2), f(G21) is a compensation gain corresponding to the coordinate point (e2, f1), and f(G22) is a compensation gain corresponding to the coordinate point (e2, f2); and f(G) is g.

In accordance with some possible embodiments of the present disclosure, the display device has a large-sized liquid crystal panel of more than 65 inches.

In a third aspect, embodiments of the present disclosure further provide a charge compensation method, which is applied to a display device and which includes: sorting inputted initial data voltages according to a pixel structure type of the display device to obtain a plurality of channels of data, each channel of the data including initial data voltages corresponding to all data lines when a gate line in a row corresponding to the channel is turned on; outputting a plurality of sets of comparison data according to the plurality of channels of data, each set of the comparison data including an actual data voltage on a data line when a gate line in a row immediately preceding a current row is turned on, and an initial data voltage on the same data line when the gate line in the current row is turned on; looking up, based on each of the sets of comparison data, actual compensation data corresponding to the set of comparison data; and compensating for, based on the actual compensation data, the initial data voltage on a data line corresponding to the actual compensation data when the gate line in the current row is turned on to obtain an actual data voltage on the data line when the gate line in the current row is turned on, and storing the actual data voltages on all the data lines when the gate line in the current row is turned on.

In accordance with some possible embodiments of the present disclosure, the charge compensation method further includes acquiring a pixel structure type of the display device.

In accordance with some possible embodiments of the present disclosure, the looking up, based on each of the sets of comparison data, the actual compensation data corresponding to the set of comparison data includes: looking up, based on each of the sets of comparison data, initial compensation data corresponding to the set of comparison data in a compensation initial data lookup table; looking up, based on each of the sets of comparison data, a compensation gain corresponding to the set of comparison data in a gain lookup table; and calculating the actual compensation data based on the initial compensation data and the compensation gain.

In accordance with some possible embodiments of the present disclosure, the looking up, based on each of the sets of comparison data, the initial compensation data corresponding to the set of comparison data in the compensation initial data lookup table includes: determining an initial compensation data c corresponding to comparison data (a, b) according to the following formulas:

$$f(R1) = \frac{x\ (s+1) - a}{x\ (s+1) - xs} f(Q11) + \frac{a - xs}{x\ (s+1) - xs} f(Q21)$$

$$f(R2) = \frac{x\ (s+1) - a}{x\ (s+1) - xs} f(Q12) + \frac{a - xs}{x\ (s+1) - xs} f(Q22)$$

$$f(p) = \frac{y\ (r+1) - b}{y\ (r+1) - yr} f(R1) + \frac{b - yr}{y\ (r+1) - yr} f(R2)$$

where the comparison data (a, b) has a corresponding coordinate point in the compensation initial data lookup table, which is located in a region defined by coordinate points (xs, yr), (xs, y(r+1)), (x(s+1), yr), (x(s+1), y(r+1)); f(Q11) is a value corresponding to the coordinate point (xs, yr) in the compensation initial data lookup table, f(Q12) is a value corresponding to the coordinate point (xs, y(r+1)) in the compensation initial data lookup table, f(Q21) is a value corresponding to the coordinate point (x(s+1), yr) in the compensation initial data lookup table, and f(Q22) is a value corresponding to the coordinate point (x(s+1), y(r+1)) in the compensation initial data lookup table; and a value of f(p) is c.

In accordance with some possible embodiments of the present disclosure, the looking up, based on each of the sets of comparison data, the compensation gain corresponding to the set of comparison data in the gain lookup table includes: calculating a compensation gain corresponding to the comparison data (a, b) by using the following formulas:

$$f(G1) = \frac{e2 - e}{e2 - e1} f(G11) + \frac{e - e1}{e2 - e1} f(G21)$$

$$f(G2) = \frac{e2 - e}{e2 - e1} f(G12) + \frac{e - e1}{e2 - e1} f(G22)$$

$$f(G) = \frac{f2 - f}{f2 - f1} f(G1) + \frac{f - f1}{f2 - f1} f(G2)$$

where a pixel coordinate of a sub-pixel corresponding to the comparison data (a, b) is (e, f), which is located in a region defined by coordinate points (e1, f1), (e1, f2), (e2, f1), and (e2, f2); f(G11) is a compensation gain corresponding to the coordinate point (e1, f1), f(G12) is a compensation gain corresponding to the coordinate point (e1, f2), f(G21) is a compensation gain corresponding to the coordinate point (e2, f1), and f(G22) is a compensation gain corresponding to the coordinate point (e2, f2); and f(G) is g.

BRIEF DESCRIPTION OF THE DRAWINGS

In order to more clearly illustrate the technical solutions of the embodiments of the present disclosure, the drawings used in the description of the embodiments of the present disclosure will be briefly described below. Apparently, the drawings in the following description relate only to some embodiments of the present disclosure. Other drawings can be obtained based on these illustrated drawings by those skilled in the art without any inventive work.

FIG. 7 is a schematic diagram showing a compensation initial data lookup table according to some embodiments of the present disclosure;

FIG. 8 is a schematic diagram showing a gain lookup table according to some embodiments of the present disclosure;

DETAILED DESCRIPTION

In order to make the technical problems to be solved, technical solutions, and advantages of the embodiments of the present disclosure more apparent, detailed description is given in conjunction with the drawings and specific embodiments.

Figure 1:
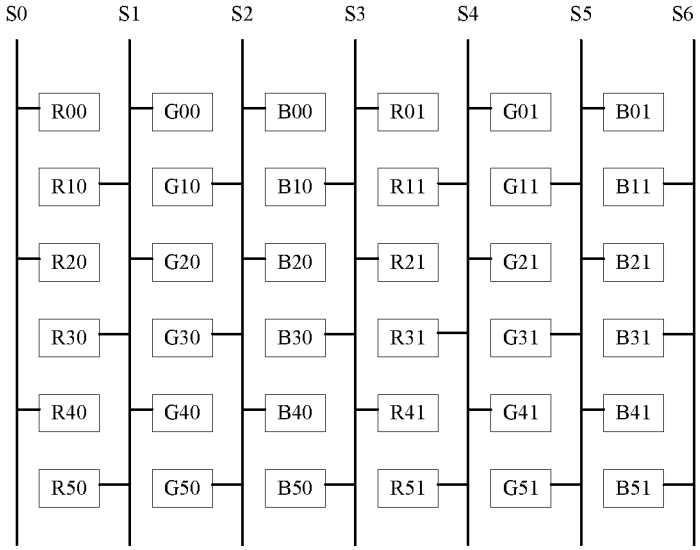
FIG. 1 is a schematic diagram of a 1G1D Z-inverted pixel structure.
Figure 2:
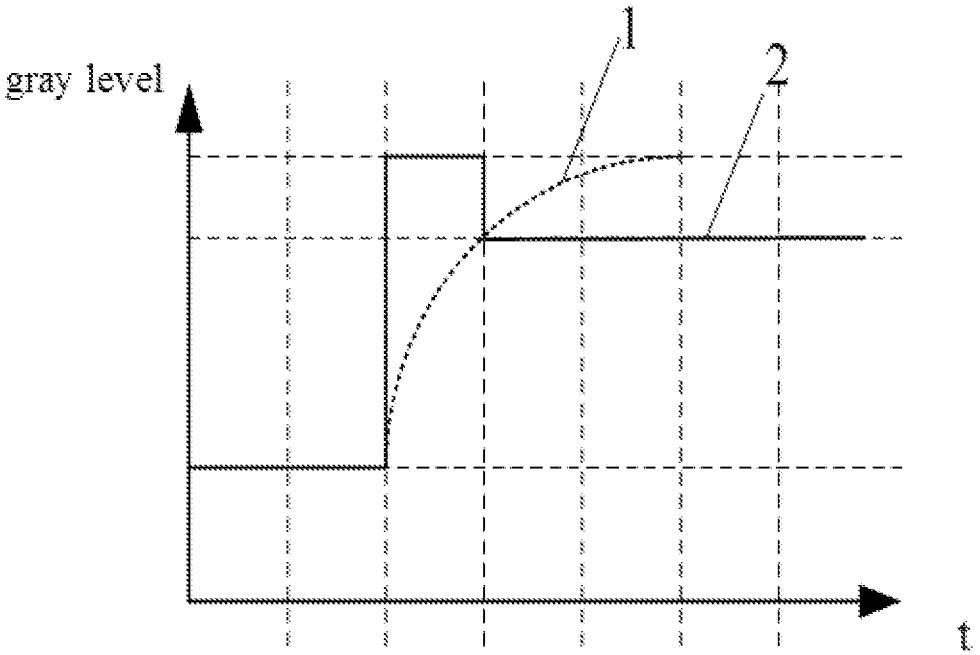
FIG. 2 is a schematic diagram showing Line OD.

In order to effectively solve the problem of the fine pitch, the related art proposes the row-level charge compensation sub-circuit which adopts Line OD technology, that is, line overcharge drive technology. FIG. 1 shows a 1G1D Z-inverted (Z inversion) pixel structure. When a yellow picture having a grayscale value of 128 is displayed, a source line (a data line) S1 is always charged with a voltage with a gray level 128, and source lines S2 and S3 are always in a case where one row is charged with a voltage with a gray level 0, and the next row is charged with a voltage with a gray level 128, which produces a phenomenon as shown in FIG. 2, for example. If the given data voltage is the voltage with the gray level 128, an effect as shown by dotted line 1 will occur due to resistance-capacitance (RC) delay during charging, so that the charging voltages on sub-pixels do not reach the voltage with the gray level 128, and charging unsaturation occurs. As a result, the fine pitch phenomenon occurs. As shown in FIG. 2, in the Line OD technology, a voltage with a gray level greater than 128 is inputted to the data lines, and the charging curve is changed from the dotted line 1 to a solid line 2, so that an actual effect on the sub-pixels is equivalent to reaching the voltage with the gray level 128. This is how the Line OD works. The Line OD has difference compensation ways for different pixel structures. In the related art, it is only known that the voltage with the gray level greater than 128 is inputted to the data lines, but no specific value is given. Moreover, the existing charge compensation sub-circuit enables only specific pixel structures, rather than all the pixel structures, to be subjected to charge compensation.

Accordingly, embodiments of the present disclosure provide a charge compensation circuit, a charge compensation method, and a display device, which are capable of solving the problem that horizontal and vertical textures appear when the screen displays a solid color picture, and are applicable to various pixel structures.

Figure 3:
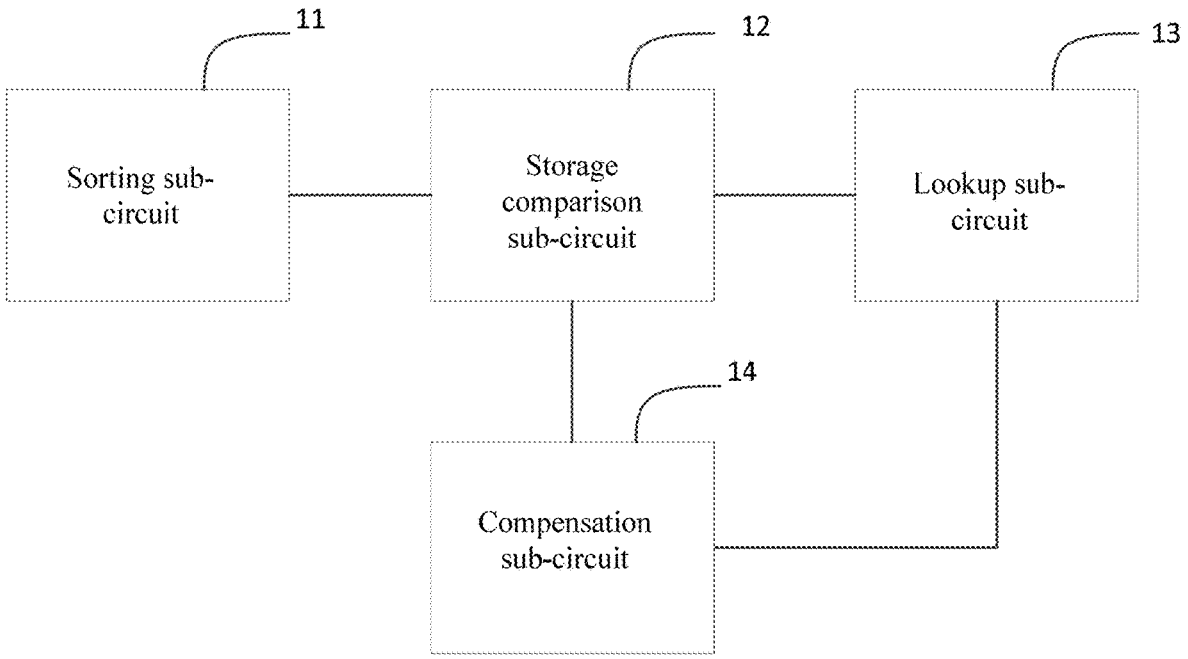
FIG. 3 is a first schematic view showing a structure of a charge compensation device according to some embodiments of the present disclosure.

An embodiment of the present disclosure provides a charge compensation circuit applied to a display device. As shown in FIG. 3, for example, the charge compensation circuit includes: a sorting sub-circuit 11, which is configured to sort inputted initial data voltages according to a pixel structure type of the display device to obtain a plurality of channels of data, each channel of the data including initial data voltages corresponding to all data lines when a gate line in a row corresponding to the channel is turned on (ON); a storage comparison sub-circuit 12, which is configured to store the sorted data and output a plurality of sets of comparison data according to the stored data, each set of the comparison data including an actual data voltage on a data line when a gate line in a row immediately preceding a current row is turned on, and an initial data voltage on the same data line when the gate line in the current row is turned on; a lookup sub-circuit 13, which is configured to look up, based on each of the sets of comparison data, actual compensation data corresponding to the set of comparison data; and a compensation sub-circuit 14, which is configured to compensate for, based on the actual compensation data, the initial data voltage on a data line corresponding to the actual compensation data when the gate line in the current row is turned on, to obtain an actual data voltage on the data line when the gate line in the current row is turned on.

In addition, the storage comparison sub-circuit 12 is further configured to store the actual data voltages on all the data lines when the gate line in the current row is turned on.

In this embodiment, the inputted initial data voltages are sorted according to the pixel structure type of the display device to obtain the plurality of channels of data, and each channels of the data includes the initial data voltages corresponding to all the data lines when the gate line in the row corresponding to the channel is turned on; the sorted data is stored, and the plurality of sets of comparison data is outputted according to the stored data, and each set of the comparison data includes the actual data voltage on the data line when the gate line in the row immediately preceding the current row is turned on, and the initial data voltage on the same data line when the gate line in the current row is turned on; the actual compensation data corresponding to each of the sets of comparison data are looked up based on the corresponding set of comparison data; and the initial data voltage on the data line corresponding to the actual compensation data when the gate line in the current row is turned on is compensated based on the actual compensation data, to obtain the actual data voltage on the data line when the gate line in the current row is turned on. The technical solution of the present disclosure can achieve the compensation of the data voltage, effectively solve the fine pitch problem, and is applicable to various types of pixel structures.

Figure 10:
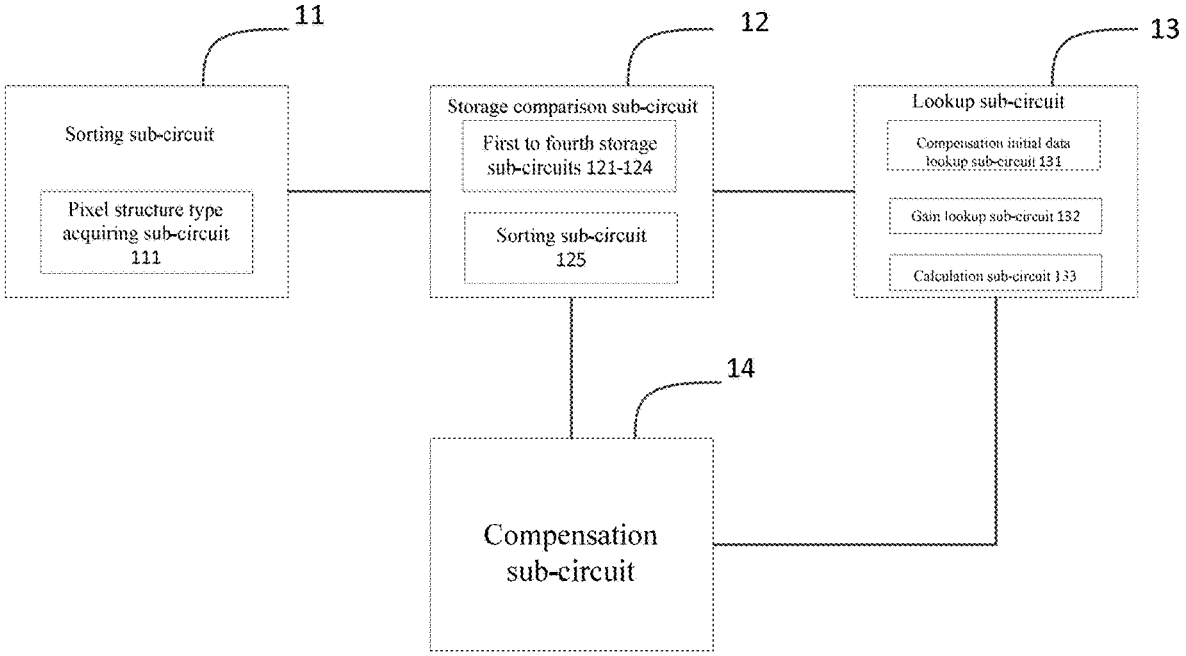
FIG. 10 is a second schematic diagram showing a structure of a charge compensation device according to another embodiment of the present disclosure.

Further, as shown in FIG. 10, the sorting sub-circuit 11 includes: a pixel structure type acquiring sub-circuit 111, which is configured to acquire a pixel structure type of the display device. Data voltages of different pixel structures are sorted in different manners. In the sorting sub-circuit 11, sorting manners for sorting data voltages of various types of pixel structures are pre-stored. When converting a data voltage, the pixel structure type is selected first, and then the sorting sub-circuit 11 can sort the input data voltages in the sorting manner corresponding to the pixel structure type.

Further, as shown in FIG. 10, the storage comparison sub-circuit 12 includes: a first storage sub-circuit 121, which is configured to store initial data voltages on all the data lines when the gate line in the row immediately preceding the current row is turned on; a second storage sub-circuit 122, which is configured to store actual data voltages on all the data lines when the gate line in the row immediately preceding the current row is turned on; a third storage sub-circuit 123, which is configured to store initial data voltages on all the data lines when the gate line in the current row is turned on; and a fourth storage sub-circuit 124, which is configured to store actual data voltages on all the data lines when the gate line in the current row is turned on.

The data stored in the first storage sub-circuit 121, the second storage sub-circuit 122, the third storage sub-circuit 123, and the fourth storage sub-circuit 124 are dynamically updated, and displayed in each row of sub-pixels. When the gate line in the current row is turned on, the first storage sub-circuit 121, the second storage sub-circuit 122, the third storage sub-circuit 123, and the fourth storage sub-circuit 124 store the data voltages corresponding to all the data lines when the gate line in the current row is turned on and the data voltage corresponding to all the data lines when the gate line in the row immediately preceding the current row is turned on, and the data voltages corresponding to the data lines include the sorted initial data voltages outputted by the sorting sub-circuit and the actual data voltages after the initial data voltages which have been subjected to charge compensation.

Further, as shown in FIG. 10, the storage comparison sub-circuit 12 further includes: a sorting sub-circuit 125, which is configured to sort the data stored in the storage comparison sub-circuit 12 and output a plurality of sets of comparison data.

Further, the lookup sub-circuit 13 includes: a compensation initial data lookup sub-circuit 131, configured to look up, based on each of the sets of comparison data, initial compensation data corresponding to the set of comparison data in a compensation initial data lookup table; a gain lookup sub-circuit 132, configured to look up, based on each of the sets of comparison data, a compensation gain corresponding to the set of comparison data in a gain lookup table; and a calculation sub-circuit 133, configured to calculate the actual compensation data based on the initial compensation data and the compensation gain.

Further, the compensation initial data lookup sub-circuit 131 is specifically configured to determine an initial compensation data c corresponding to comparison data (a, b) according to the following formulas:

$$f(R1) = \frac{x\ (s+1) - a}{x\ (s+1) - xs} f(Q11) + \frac{a - xs}{x\ (s+1) - xs} f(Q21)$$

$$f(R2) = \frac{x\ (s+1) - a}{x\ (s+1) - xs} f(Q12) + \frac{a - xs}{x\ (s+1) - xs} f(Q22)$$

$$f(p) = \frac{y\ (r+1) - b}{y\ (r+1) - yr} f(R1) + \frac{b - yr}{y\ (r+1) - yr} f(R2)$$

where the comparison data (a, b) has a corresponding coordinate point in the compensation initial data lookup table, which is located in a region defined by coordinate points (xs, yr), (xs, y(r+1)), (x(s+1), yr), (x(s+1), y(r+1)); f(Q11) is a value corresponding to the coordinate point (xs, yr) in the compensation initial data lookup table, f(Q12) is a value corresponding to the coordinate point (xs, y(r+1)) in the compensation initial data lookup table, f(Q21) is a value corresponding to the coordinate point (x(s+1), yr) in the compensation initial data lookup table, and f(Q22) is a value corresponding to the coordinate point (x(s+1), y(r+1)) in the compensation initial data lookup table; and a value of f(p) is c.

Further, the gain lookup sub-circuit 132 is specifically configured to calculate a compensation gain corresponding to the comparison data (a, b) by using the following formulas:

$$f(G1) = \frac{e2 - e}{e2 - e1} f(G11) + \frac{e - e1}{e2 - e1} f(G21)$$

$$f(G2) = \frac{e2 - e}{e2 - e1} f(G12) + \frac{e - e1}{e2 - e1} f(G22)$$

$$f(G) = \frac{f2 - f}{f2 - f1} f(G1) + \frac{f - f1}{f2 - f1} f(G2)$$

where a pixel coordinate of a sub-pixel corresponding to the comparison data (a, b) is (e, f), which is located in a region defined by coordinate points (e1, f1), (e1, f2), (e2, f1), and (e2, f2); f(G11) is a compensation gain corresponding to the coordinate point (e1, f1), f(G12) is a compensation gain corresponding to the coordinate point (e1, f2), f(G21) is a compensation gain corresponding to the coordinate point (e2, f1), and f(G22) is a compensation gain corresponding to the coordinate point (e2, f2); and f(G) is g.

In addition, embodiments of the present disclosure further provide a display device including the charge compensation circuit as described above. The display device may be any product or component having a display function, such as a television, a display, a digital photo frame, a mobile phone, a tablet computer, and so on. Furthermore, the display device further includes a flexible circuit board, a printed circuit board, a backplane, and so forth.

Figure 4:
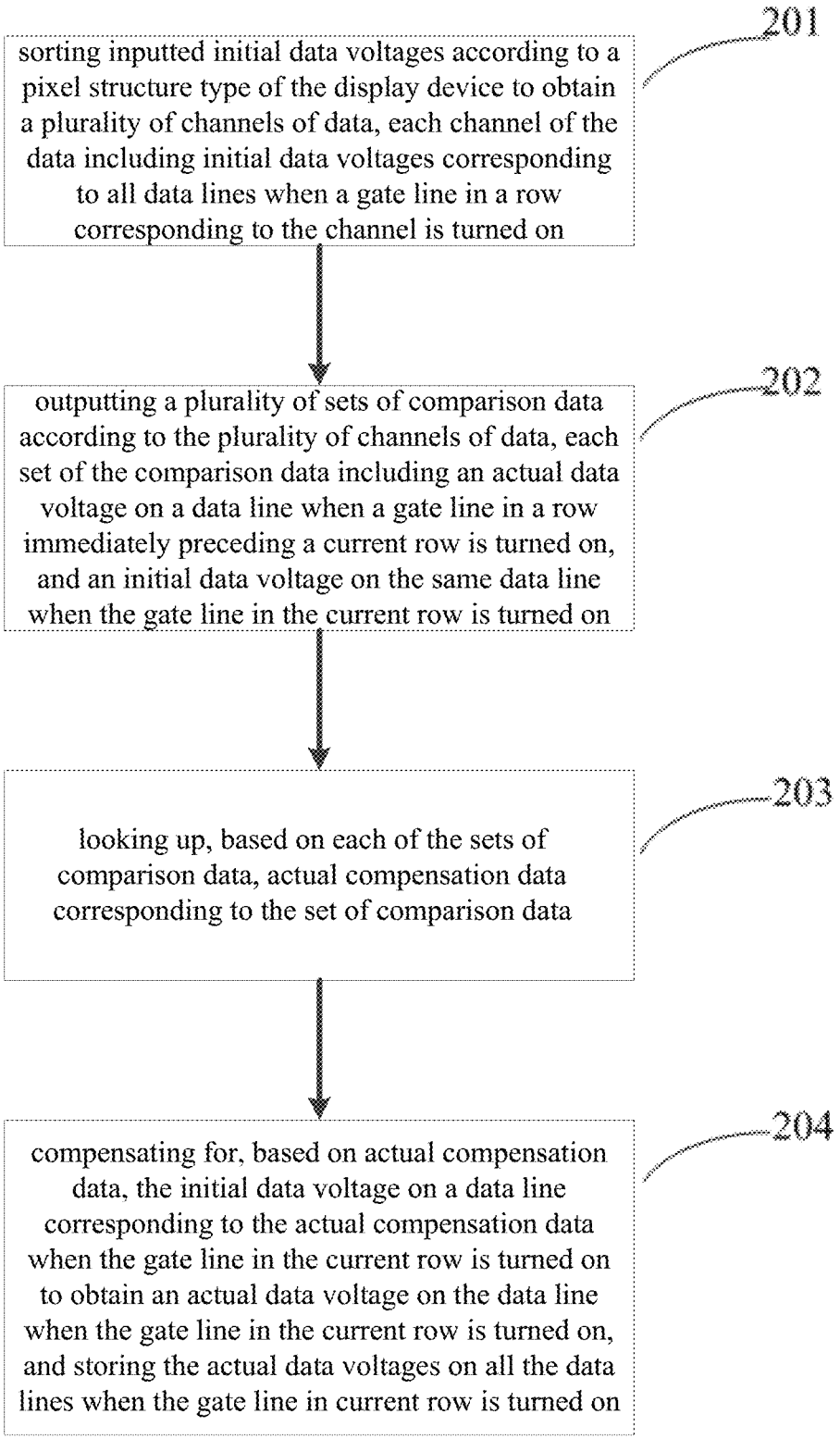
FIG. 4 is a schematic flow chart of a charge compensation method according to some embodiments of the present disclosure.

In addition, as shown in FIG. 4, the embodiments of the present disclosure further provide a charge compensation method, which is applied to a display device, and which includes, for example: sorting inputted initial data voltages according to a pixel structure type of the display device to obtain a plurality of channels of data, each channel of the data including initial data voltages corresponding to all data lines when a gate line in a row corresponding to the channel is turned on (step 201); outputting a plurality of sets of comparison data according to the plurality of channels of data, each set of the comparison data including an actual data voltage on a data line when a gate line in a row immediately preceding a current row is turned on, and an initial data voltage on the same data line when the gate line in the current row is turned on (steps) 202); looking up, based on each of the sets of comparison data, actual compensation data corresponding to the set of comparison data (step 203); and compensating for, based on the actual compensation data, the initial data voltage on a data line corresponding to the actual compensation data when the gate line in the current row is turned on to obtain an actual data voltage on the data line when the gate line in the current row is turned on, and storing the actual data voltages on all the data lines when the gate line in the current row is turned on (step 204).

In this embodiment, the inputted initial data voltages are sorted according to the pixel structure type of the display device to obtain the plurality of channels of data, and each channels of the data includes the initial data voltages corresponding to all the data lines when the gate line in the row corresponding to the channel is turned on; the sorted data is stored, and the plurality of sets of comparison data is outputted according to the stored data, and each set of the comparison data includes the actual data voltage on the data line when the gate line in the row immediately preceding the current row is turned on, and the initial data voltage on the same data line when the gate line in the current row is turned on; the actual compensation data corresponding to each of the sets of comparison data are looked up based on the corresponding set of comparison data; and the initial data voltage on the data line corresponding to the actual compensation data when the gate line in the current row is turned on is compensated based on the actual compensation data, to obtain the actual data voltage on the data line when the gate line in the current row is turned on. The technical solution of the present disclosure can achieve the compensation of the data voltage, effectively solve the fine pitch problem, and is applicable to various types of pixel structures.

Further, the charge compensation method further includes: acquiring a pixel structure type of the display device. Data voltages of different pixel structures are sorted in different manners. Sorting manners for sorting data voltages of various types of pixel structures are pre-stored. When converting a data voltage, the pixel structure type is selected first, and then the input data voltages can be sorted in the sorting manner corresponding to the pixel structure type.

Further, the looking up, based on each of the sets of comparison data, the actual compensation data corresponding to the set of comparison data includes: looking up, based on each of the sets of comparison data, initial compensation data corresponding to the set of comparison data in a compensation initial data lookup table; looking up, based on each of the sets of comparison data, a compensation gain corresponding to the set of comparison data in a gain lookup table; and calculating the actual compensation data based on the initial compensation data and the compensation gain.

Further, the looking up, based on each of the sets of comparison data, the initial compensation data corresponding to the set of comparison data in the compensation initial data lookup table includes: determining an initial compensation data c corresponding to comparison data (a, b) according to the following formulas:

$$f(R1) = \frac{x\ (s+1) - a}{x\ (s+1) - xs} f(Q11) + \frac{a - xs}{x\ (s+1) - xs} f(Q21)$$

$$f(R2) = \frac{x\ (s+1) - a}{x\ (s+1) - xs} f(Q12) + \frac{a - xs}{x\ (s+1) - xs} f(Q22)$$

$$f(p) = \frac{y\ (r+1) - b}{y\ (r+1) - yr} f(R1) + \frac{b - yr}{y\ (r+1) - yr} f(R2)$$

where the comparison data (a, b) has a corresponding coordinate point in the compensation initial data lookup table, which is located in a region defined by coordinate points (xs, yr), (xs, y(r+1)), (x(s+1), yr), (x(s+1), y(r+1)); f(Q11) is a value corresponding to the coordinate point (xs, yr) in the compensation initial data lookup table, f(Q12) is a value corresponding to the coordinate point (xs, y(r+1)) in the compensation initial data lookup table, f(Q21) is a value corresponding to the coordinate point (x(s+1), yr) in the compensation initial data lookup table, and f(Q22) is a value corresponding to the coordinate point (x(s+1), y(r+1)) in the compensation initial data lookup table; and a value of f(p) is c.

Further, the looking up, based on each of the sets of comparison data, the compensation gain corresponding to the set of comparison data in the gain lookup table includes: calculating a compensation gain corresponding to the comparison data (a, b) by using the following formulas:

$$f(G1) = \frac{e2 - e}{e2 - e1} f(G11) + \frac{e - e1}{e2 - e1} f(G21)$$

$$f(G2) = \frac{e2 - e}{e2 - e1} f(G12) + \frac{e - e1}{e2 - e1} f(G22)$$

$$f(G) = \frac{f2 - f}{f2 - f1} f(G1) + \frac{f - f1}{f2 - f1} f(G2)$$

where a pixel coordinate of a sub-pixel corresponding to the comparison data (a, b) is (e, f), which is located in a region defined by coordinate points (e1, f1), (e1, f2), (e2, f1), and (e2, f2); f(G11) is a compensation gain corresponding to the coordinate point (e1, f1), f(G12) is a compensation gain corresponding to the coordinate point (e1, f2), f(G21) is a compensation gain corresponding to the coordinate point (e2, f1), and f(G22) is a compensation gain corresponding to the coordinate point (e2, f2); and f(G) is g.

The technical solutions of the present disclosure are further described below in conjunction with the accompanying drawings and specific embodiments.

Figures 5, 6:
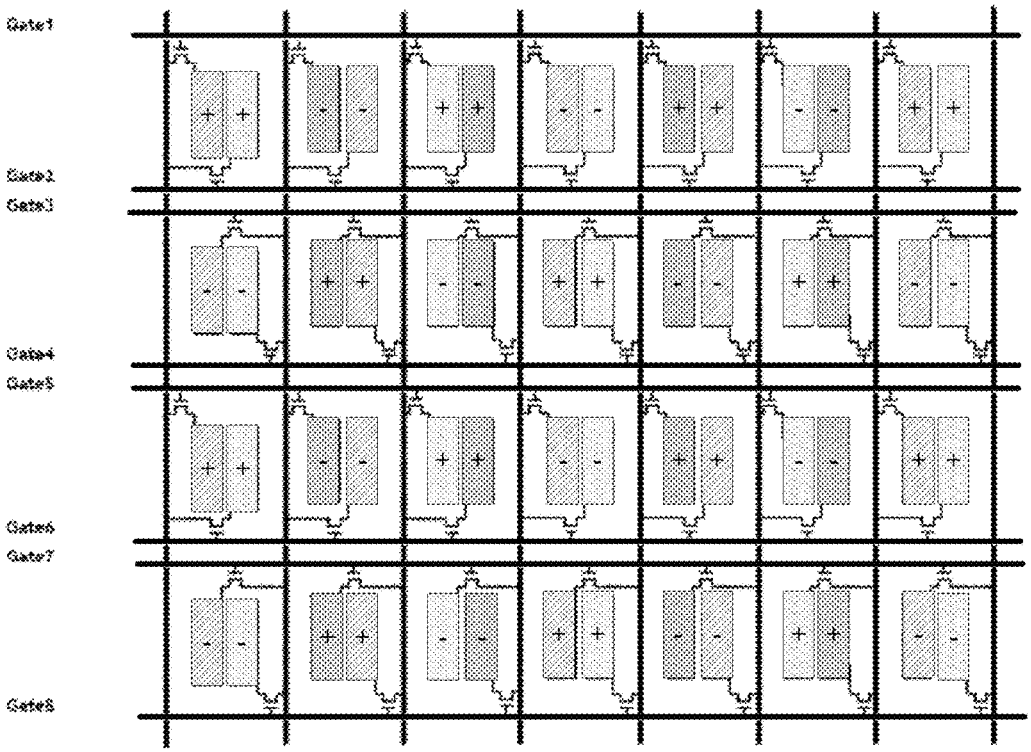
FIG. 5 is a schematic diagram showing a 2G1D Z-inverted pixel structure.
FIG. 6 is a schematic diagram showing initial data voltages inputted to the pixel structure shown in FIG. 5 and the sorted initial data voltages.

FIG. 5 is a schematic diagram showing a 2G1D Z-inverted pixel structure. As shown in FIG. 6, when a display device of such a pixel structure performs display, initial data voltages inputted are: R0, G0, B0, R1, G1, B1, R2, G2, B2, R3, G3, B3, R4, G4, B4, R5, G5, B5, R6, G6, B6, R7, G7, B7, . . . . Among them, R0 and G0 are the initial data voltages sequentially inputted on Data1, B0 and R1 are the initial data voltages sequentially inputted on Data2, G1 and B1 are the initial data voltages sequentially inputted on Data3, and so on. R0 is the initial data voltage of the a red sub-pixel in a pixel unit of a first row by a first column, B0 is the initial data voltage of a blue sub-pixel in the pixel unit of the first row by the first column, and G0 is the initial data voltage of a green sub-pixel in the pixel unit of the first row by the first column, R1 is the initial data voltage of a red sub-pixel in a pixel unit of a first row by a second column, and B1 is the initial data voltage of a blue sub-pixel in the pixel unit of the first row by the second column, and G1 is the initial data voltage of a green sub-pixel in the pixel unit of the first row by the second column, . . . , and so on.

When charge compensation is performed, the data voltages to be compared are the initial data voltage to be inputted on a data line when the gate line in the current row is turned on and the data voltage inputted on the same data line when the gate line in a row immediately preceding the current row is turned on, but the order of the inputted data voltages does not satisfy a requirement for data voltage comparison. Therefore, it is necessary to re-order the inputted data voltages to form at least two channels of data, of which a first channel includes data voltages corresponding to m number of data lines when a gate line in a row immediately preceding a current row is turned on, and a second channel includes data voltages corresponding to the m number of data lines when the gate line in the current row is turned on, where m is a total number of the data lines.

The data voltages of different pixel structures are sorted in different manners. In the sorting sub-circuit, sorting manners for sorting data voltages of various types of pixel structures are pre-stored. When converting a data voltage, the pixel structure type is selected first, and then the sorting sub-circuit can sort the input data voltages in the sorting manner corresponding to the pixel structure type. Specifically, the pixel structure type can be inputted through a pixel structure type port of the sorting sub-circuit.

As shown in FIG. 6, after sorting the inputted data voltages R0, G0, B0, R1, G1, B1, R2, G2, B2, R3, G3, B3, R4, G4, B4, R5, G5, B5, R6, G6, B6, R7, G7, B7, . . . , a first channel of data voltages are R0, B1, G1, R2, B2, G3, R4, B4, G5, R6, B6, G7, . . . , and a second channel of data voltages are G0, R1, B1, G2, R3, B3, G4, R5, B5, G6, R7, B7, . . . , wherein an $i^{th}$ data of each channel of the data voltages is a data voltage corresponding to an $i^{th}$ data line, where i is a positive integer less than or equal to m. Specifically, it is necessary to refer to FIG. 5 for a corresponding relationship shown in FIG. 6. For example, three sub-pixels in first three columns from a left side of a first row of FIG. 5 represent a red (R) sub-pixel, a green (G) sub-pixel, and a blue (B) sub-pixel, respectively. Similarly, RGB shown in FIG. 6 represents red, green, and blue, and the numbers following them represent sorting numbers of these pixels. FIG. 6 shows an abscissa which is a vertical line shown in FIG. 5, and an ordinate which is a horizontal line shown in FIG. 5. Values in FIG. 6 are color patches of sub-pixels connected to the horizontal and vertical lines and presented by a triode of sub-pixels. For example, as shown in FIG. 6, on Gate1, first two sub-pixels counted from the left side are R0 and B0 in sequence, and G0 is located in the second row, namely Gate2.

A storage circuit is needed to store the sorted data voltages, and it may include a plurality of storage sub-circuits, which includes a storage sub-circuit that is required to store data voltages corresponding to m data lines when a gate line in a row immediately preceding a current row is turned on, wherein the data voltages corresponding to the m data lines include initial data voltages and the data voltages having been subjected to charge compensation. Therefore, there is a need for two storage sub-circuits to store the initial data voltages on the m number of data lines when the gate line in the row immediately preceding the current row is turned on and the data voltages on the m number of data lines having been subjected to the charge compensation when the gate line in the row immediately preceding the current row is turned on, i.e., the actual data voltages, respectively. There is also a need for a storage sub-circuit to store data voltages corresponding to the m number of data lines when the gate line in the current row is turned on, where the data voltages corresponding to the m number of data lines include the initial data voltages and the data voltages having been subjected to charge compensation. Therefore, there is a need for two storage sub-circuits to store the initial data voltages on the m number of data lines when the gate line in the current row is turned on, and the data voltages on the m number of data lines having been subjected to the charge compensation when the gate line in the current row is turned on, i.e., the actual data voltages, respectively. In summary, a total of four storage sub-circuits 121, 122, 123, and 124 are needed to store the initial data voltages on the m number of data lines when the gate line in the row immediately preceding the current row is turned on, the actual data voltages on the m number of data lines when the gate line in the row immediately preceding the current row is turned on, the initial data voltages on the m number of data lines when the gate line in the current row is turned on, and the actual data voltages on the m number of data lines when the gate line in the current row is turned on.

When data comparison is performed, the actual data voltage on a data line when a gate line in a row preceding a current row is turned on and the initial data voltage on the same data line when the gate line in the current row is turned on are compared to obtain a set of comparison data (a, b), where the actual data voltage on the data line when the gate line in the row preceding the current row is turned on is a, and the initial data voltage to be inputted on the same data line when the gate line in the current row is turned on is b, and this set of data can be used to look up corresponding compensation data in the lookup table.

Specifically, the storage circuit further includes a sorting sub-circuit 125 capable of reading out a plurality of sets of comparison data from the four storage sub-circuits 121, 122, 123, and 124.

Specifically, there are two lookup tables stored in the lookup sub-circuit 13, one of which is a compensation initial data lookup table as shown in FIG. 7, and the other of which is a gain lookup table as shown in FIG. 8. Of course, it can be understood that the compensation initial data lookup table shown in FIG. 7 and the gain lookup table shown in FIG. 8 are both illustrative, rather than limiting. A person skilled in the art can also design another compensation initial data lookup table and another gain lookup table including other entries according to actual needs.

In the compensation initial data lookup table, row coordinates represent the actual data voltages on the data lines when a gate line in a row immediately preceding a current row is turned on, and column coordinates represent the initial data voltages to be inputted on the data lines when the gate line in the current row is turned on, and a value of each of the coordinate points in the table represents an initial compensation data. For example, a value of the coordinate point (a, b) is c, representing that when the actual data voltage on the data line when the gate line in the row immediately preceding the current row is turned on is a, and the initial data voltage to be inputted on the data line when the gate line in the current row is turned on is b, the corresponding initial compensation data is c.

The row coordinates of the compensation initial data lookup table include a plurality of sequentially increasing first data voltage values, which are x1, x2, . . . , xq in sequence, and the column coordinates include a plurality of sequentially increasing second data voltage values, which are y1, y2, yp in sequence, where p, q are positive integers. Specifically, as shown in FIG. 7, the first data voltage value and the second data voltage value may be represented by gray levels, such as 0, 8, 16, . . . , 255. For the set of comparison data (a, b), the value of a may not be any one of x1, x2, . . . , xq, but may be between two adjacent values of x1, x2, . . . , xq; the value of b may not be any one of y1, y2, . . . , yp, but may be between two adjacent values of y1 y2, . . . , yp. In this case, a bilinear interpolation algorithm needs to be used to determine the value c of the set of comparison data (a, b).

Figure 9:
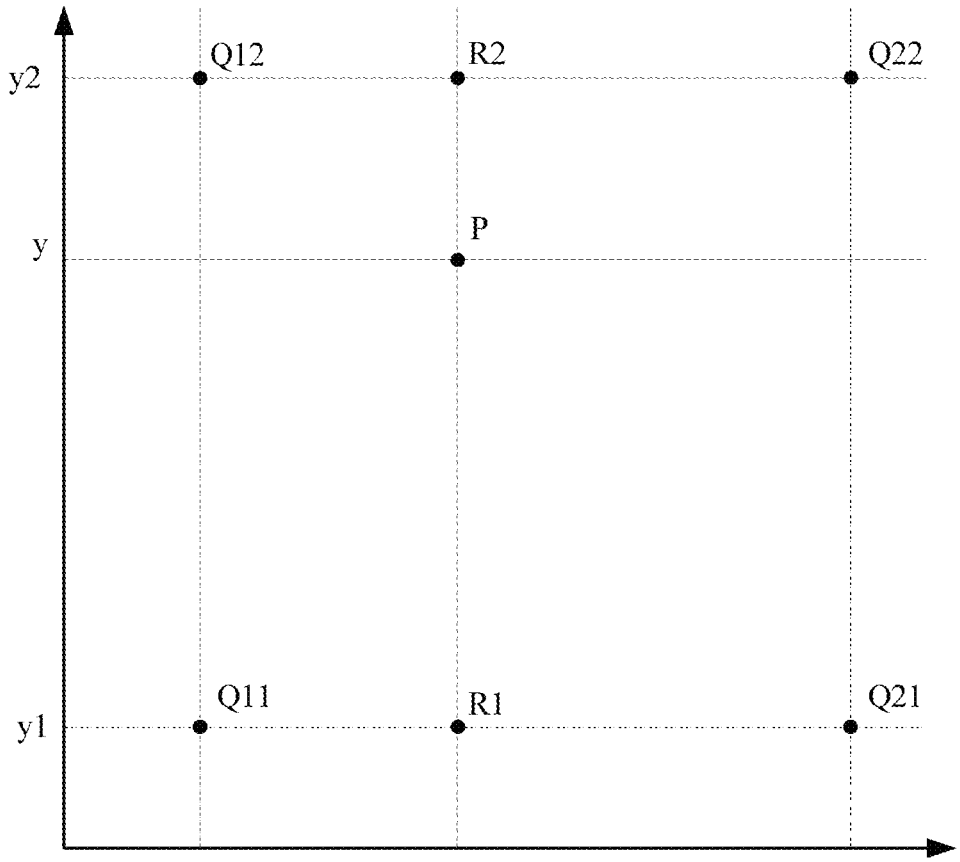
FIG. 9 is a schematic diagram showing a bilinear interpolation algorithm.

A schematic diagram of the bilinear interpolation algorithm is shown in FIG. 9, in which a value of a point P is required to be obtained. Coordinates and data at four points Q11, Q12, Q21, and Q22 are known. Data at points R1 and R2 is obtained first, which is first linear interpolation, and data at the point P is then obtained, which is second linear interpolation.

Specifically, when determining the value c of (a, b) by using the bilinear interpolation algorithm, a first step is to determine two adjacent values xs, x(s+1) in x1, x2, . . . , xq, which need to satisfy a condition that xs is less than a and a is less than x(s+1); and to determine two adjacent values yr, y(r+1) in y1, y2, . . . , yp, which need to satisfy a condition that yr is less than b and b is less than y(r+1). Then, c is calculated by using the following formulas:

$$f(R1) = \frac{x\ (s+1) - a}{x\ (s+1) - xs} f(Q11) + \frac{a - xs}{x\ (s+1) - xs} f(Q21)$$

$$f(R2) = \frac{x\ (s+1) - a}{x\ (s+1) - xs} f(Q12) + \frac{a - xs}{x\ (s+1) - xs} f(Q22)$$

$$f(p) = \frac{y\ (r+1) - b}{y\ (r+1) - yr} f(R1) + \frac{b - yr}{y\ (r+1) - yr} f(R2)$$

where f(Q11) is a value corresponding to the coordinate point (xs, yr), f(Q12) is a value corresponding to the coordinate point (xs, y(r+1)), f(Q21) is a value corresponding to the coordinate point (x(s+1), yr), and f(Q22) is a value corresponding to the coordinate point (x(s+1), y(r+1)); and a value of f(p) is c.

After the initial compensation data c of the comparison data (a, b) has been determined, it is also necessary to determine a corresponding compensation gain. A display screen is divided into a plurality of areas, and a gain value corresponding to each of the areas of the display screen is stored in the gain lookup table. Specifically, the gain value in a central area of the display screen may be 1, and the gain values of the other areas are different from the gain value in the central area. A coordinate point of the sub-pixel to be subjected to charge compensation in the display screen is determined, and then a corresponding compensation gain is looked up in the gain lookup table based on the determined coordinate point.

In a specific example, as shown in FIG. 8, the display screen includes sub-pixels of 3840 rows by 2160 columns, and the display screen is divided into 12*8 partitions, four corners of each of the partitions are used as reference points, and there are a total of 13*9 reference points. As shown in FIG. 8, the row coordinates in the gain lookup table are row pixel coordinates of the reference points in the display screen, such as 0, 320, 640, . . . , 3839, and column coordinates in the gain lookup table are column pixel coordinates of the reference points in the display screen, such as 0, 270, 540, . . . , 2159. A sub-pixel to be subjected to charge compensation may not be a reference point, but may be located in an area defined by four reference points. In this case, it is necessary to use the bilinear interpolation algorithm to determine a compensation gain g corresponding to the sub-pixel. Specifically, g can be obtained by using the following formulas:

$$f(G1) = \frac{e2 - e}{e2 - e1} f(G11) + \frac{e - e1}{e2 - e1} f(G21)$$

$$f(G2) = \frac{e2 - e}{e2 - e1} f(G12) + \frac{e - e1}{e2 - e1} f(G22)$$

$$f(G) = \frac{f2 - f}{f2 - f1} f(G1) + \frac{f - f1}{f2 - f1} f(G2)$$

where a pixel coordinate of a sub-pixel corresponding to the comparison data (a, b) is (e, f), which is located in a region defined by coordinate points (e1, f1), (e1, f2), (e2, f1), and (e2, f2); f(G11) is a compensation gain corresponding to the coordinate point (e1, f1), f(G12) is a compensation gain corresponding to the coordinate point (e1, f2), f(G21) is a compensation gain corresponding to the coordinate point (e2, f1), and f(G22) is a compensation gain corresponding to the coordinate point (e2, f2); and f(G) is g.

After the initial compensation data c and the compensation gain g have been obtained, an actual compensation data can be obtained as c*g, an actual data voltage after having been subjected to charge compensation can be obtained by adding the initial data voltage and the actual compensation data on the same data line. By inputting the actual data voltage to the data line, it is possible to effectively solve the fine pitch problem, and the technical solution of the embodiment is applicable to various types of pixel structures.

Unless otherwise defined, technical or scientific terms used herein should have the same meaning as commonly understood by those having ordinary skills in the art to which the present disclosure pertains. Terms such as "first" and "second" used herein are used merely to distinguish different constituent components rather than to indicate any sequence, number or importance. The terms "comprising", "including" or other variants thereof are intended to mean that the element or item stated before such terms encompasses elements, items and equivalents thereof listed after these terms without excluding other elements or items not expressly listed. The terms "connect", "connected" or the like are not intended to define physical or mechanical connection, but may include an electrical connection, either direct or indirect. Such words as "up", "down", "left" and "right" are merely used to represent a relative positional relationship, and when an absolute position of the described object is changed, the relative position relationship will be changed accordingly.

It will be understood that when an element such as a layer, a film, a region or a substrate is referred to as being "on" or "under" another element, it can be directly "on" or "under" the other element, or an intervening element may be present.

The above are preferred embodiments of the present disclosure, and it shall be indicated that several improvements and modifications may be made by those having ordinary skills in the art without departing from the principle of the present disclosure, and such improvements and modifications shall also be regarded as falling within the protection scope of the present disclosure.

What is claimed is:

1. A charge compensation circuit, applied to a display device and comprising:

a sorting sub-circuit, configured to sort inputted initial data voltages according to a pixel structure type of the display device to obtain a plurality of channels of data, each channel of the data comprising initial data voltages corresponding to all data lines when a gate line in a row corresponding to the channel is turned on;

a storage comparison sub-circuit, configured to store the sorted data and output a plurality of sets of comparison data according to the stored data, each set of the comparison data comprising an actual data voltage on a data line when a gate line in a row immediately preceding a current row is turned on, and an initial data voltage on the same data line when the gate line in the current row is turned on;

a lookup sub-circuit, configured to look up, based on each of the sets of comparison data, actual compensation data corresponding to the set of comparison data; and a compensation sub-circuit, configured to compensate for, based on the actual compensation data, the initial data voltage on a data line corresponding to the actual compensation data when the gate line in the current row is turned on, to obtain an actual data voltage on the data line when the gate line in the current row is turned on, wherein the storage comparison sub-circuit is further configured to store the actual data voltages on all the data lines when the gate line in the current row is turned on, wherein the lookup sub-circuit comprises:

a compensation initial data lookup sub-circuit, configured to look up, based on each of the sets of comparison data, initial compensation data corresponding to the set of comparison data in a compensation initial data lookup table;

a gain lookup sub-circuit, configured to look up, based on each of the sets of comparison data, a compensation gain corresponding to the set of comparison data in a gain lookup table; and a calculation sub-circuit, configured to calculate the actual compensation data based on the initial compensation data and the compensation gain, wherein the compensation initial data lookup sub-circuit is further configured to determine an initial compensation data c corresponding to comparison data (a, b) according to the following formulas:

$$f(R1) = \frac{x\ (s+1) - a}{x\ (s+1) - xs} f(Q11) + \frac{a - xs}{x\ (s+1) - xs} f(Q21)$$

$$f(R2) = \frac{x\ (s+1) - a}{x\ (s+1) - xs} f(Q12) + \frac{a - xs}{x\ (s+1) - xs} f(Q22)$$

$$f(p) = \frac{y\ (r+1) - b}{y\ (r+1) - yr} f(R1) + \frac{b - yr}{y\ (r+1) - yr} f(R2)$$

where the comparison data (a, b) has a corresponding coordinate point in the compensation initial data lookup table, which is located in a region defined by coordinate points (xs, yr), (xs, y(r+1)), (x(s+1), yr), (x(s+1), y(r+1)); f(Q11) is a value corresponding to the coordinate point (xs, yr) in the compensation initial data lookup table, f(Q12) is a value corresponding to the coordinate point (xs, y(r+1)) in the compensation initial data lookup table, f(Q21) is a value corresponding to the coordinate point (x(s+1), yr) in the compensation initial data lookup table, and f(Q22) is a value corresponding to the coordinate point (x(s+1), y(r+1)) in the compensation initial data lookup table; and a value of f(p) is c.

2. The charge compensation circuit according to claim 1, wherein the sorting sub-circuit comprises:

a pixel structure type acquiring sub-circuit, configured to acquire a pixel structure type of the display device.

3. The charge compensation circuit according to claim 1, wherein the storage comparison sub-circuit comprises:

a first storage sub-circuit, configured to store initial data voltages on all the data lines when the gate line in the row immediately preceding the current row is turned on;

a second storage sub-circuit, configured to store actual data voltages on all the data lines when the gate line in the row immediately preceding the current row is turned on;

a third storage sub-circuit, configured to store initial data voltages on all the data lines when the gate line in the current row is turned on; and a fourth storage sub-circuit, configured to store actual data voltages on all the data lines when the gate line in the current row is turned on.

4. The charge compensation circuit according to claim 3, wherein the storage comparison sub-circuit further comprises:

a sorting sub-circuit configured to sort the data stored in the storage comparison sub-circuit and output a plurality of sets of comparison data.

5. The charge compensation circuit according to claim 1, wherein the gain lookup sub-circuit is further configured to calculate a compensation gain corresponding to the comparison data (a, b) by using the following formulas:

$$f(G1) = \frac{e2-e}{e2-e1}f(G11) + \frac{e-e1}{e2-e1}f(G21)$$

$$f(G2) = \frac{e2-e}{e2-e1}f(G12) + \frac{e-e1}{e2-e1}f(G22)$$

$$f(G) = \frac{f2-f}{f2-f1}f(G1) + \frac{f-f1}{f2-f1}f(G2)$$

where a pixel coordinate of a sub-pixel corresponding to the comparison data (a, b) is (e, f), which is located in a region defined by coordinate points (e1, f1), (e1, f2), (e2, f1), and (e2, f2); f(G11) is a compensation gain corresponding to the coordinate point (e1, f1), f(G12) is a compensation gain corresponding to the coordinate point (e1, f2), f(G21) is a compensation gain corresponding to the coordinate point (e2, f1), and f(G22) is a compensation gain corresponding to the coordinate point (e2, f2); and f(G) is g.

6. A display device, comprising a charge compensation circuit that is applied to a display device, the charge compensation circuit comprising:

a sorting sub-circuit, configured to sort inputted initial data voltages according to a pixel structure type of the display device to obtain a plurality of channels of data, each channel of the data comprising initial data voltages corresponding to all data lines when a gate line in a row corresponding to the channel is turned on;

a storage comparison sub-circuit, configured to store the sorted data and output a plurality of sets of comparison data according to the stored data, each set of the comparison data comprising an actual data voltage on a data line when a gate line in a row immediately preceding a current row is turned on, and an initial data voltage on the same data line when the gate line in the current row is turned on;

a lookup sub-circuit, configured to look up, based on each of the sets of comparison data, actual compensation data corresponding to the set of comparison data; and a compensation sub-circuit, configured to, based on the actual compensation data, compensate for the initial data voltage on a data line corresponding to the actual compensation data when the gate line in the current row is turned on, to obtain an actual data voltage on the data line when the gate line in the current row is turned on, wherein the storage comparison sub-circuit is further configured to store the actual data voltages on all the data lines when the gate line in the current row is turned on, wherein the lookup sub-circuit comprises:

a compensation initial data lookup sub-circuit, configured to look up, based on each of the sets of comparison data, initial compensation data corresponding to the set of comparison data in a compensation initial data lookup table;

a gain lookup sub-circuit, configured to look up, based on each of the sets of comparison data, a compensation gain corresponding to the set of comparison data in a gain lookup table; and a calculation sub-circuit, configured to calculate the actual compensation data based on the initial compensation data and the compensation gain;

wherein the compensation initial data lookup sub-circuit is further configured to determine an initial compensation data c corresponding to comparison data (a, b) according to the following formulas:

$$f(R1) = \frac{x\ (s+1)-a}{x\ (s+1)-xs}f(Q11) + \frac{a-xs}{x\ (s+1)-xs}f(Q21)$$

$$f(R2) = \frac{x\ (s+1)-a}{x\ (s+1)-xs}f(Q12) + \frac{a-xs}{x\ (s+1)-xs}f(Q22)$$

$$f(p) = \frac{y\ (r+1)-b}{y\ (r+1)-yr}f(R1) + \frac{b-yr}{y\ (r+1)-yr}f(R2)$$

where the comparison data (a, b) has a corresponding coordinate point in the compensation initial data lookup table, which is located in a region defined by coordinate points (xs, yr), (xs, y(r+1)), (x(s+1), yr), (x(s+1), y(r+1)); f(Q11) is a value corresponding to the coordinate point (xs, yr) in the compensation initial data lookup table, f(Q12) is a value corresponding to the coordinate point (xs, y(r+1)) in the compensation initial data lookup table, f(Q21) is a value corresponding to the coordinate point (x(s+1), yr) in the compensation initial data lookup table, and f(Q22) is a value corresponding to the coordinate point (x(s+1), y(r+1)) in the compensation initial data lookup table; and a value of f(p) is c.

7. The display device according to claim 6, wherein the sorting sub-circuit comprises:

a pixel structure type acquiring sub-circuit, configured to acquire a pixel structure type of the display device.

8. The display device according to claim 6, wherein the storage comparison sub-circuit comprises:

a first storage sub-circuit, configured to store initial data voltages on all the data lines when the gate line in the row immediately preceding the current row is turned on;

a second storage sub-circuit, configured to store actual data voltages on all the data lines when the gate line in the row immediately preceding the current row is turned on;

a third storage sub-circuit, configured to store initial data voltages on all the data lines when the gate line in the current row is turned on; and a fourth storage sub-circuit, configured to store actual data voltages on all the data lines when the gate line in the current row is turned on.

9. The display device according to claim 8, wherein the storage comparison sub-circuit further comprises:

a sorting sub-circuit configured to sort the data stored in the storage comparison sub-circuit and output a plurality of sets of comparison data.

10. The display device according to claim 6, wherein the gain lookup sub-circuit is further configured to calculate a compensation gain corresponding to the comparison data (a, b) by using the following formulas:

$$f(G1) = \frac{e2-e}{e2-e1} f(G11) + \frac{e-e1}{e2-e1} f(G21)$$

$$f(G2) = \frac{e2-e}{e2-e1} f(G12) + \frac{e-e1}{e2-e1} f(G22)$$

$$f(G) = \frac{f2-f}{f2-f1} f(G1) + \frac{f-f1}{f2-f1} f(G2)$$

where a pixel coordinate of a sub-pixel corresponding to the comparison data (a, b) is (e, f), which is located in a region defined by coordinate points (e1, f1), (e1, f2), (e2, f1), and (e2, f2); f(G11) is a compensation gain corresponding to the coordinate point (e1, f1), f(G12) is a compensation gain corresponding to the coordinate point (e1, f2), f(G21) is a compensation gain corresponding to the coordinate point (e2, f1), and f(G22) is a compensation gain corresponding to the coordinate point (e2, f2); and f(G) is g.

11. The display device according to claim 6, wherein the display device has a large-sized liquid crystal panel of more than 65 inches.

12. A charge compensation method, applied to a display device and comprising:

sorting inputted initial data voltages according to a pixel structure type of the display device to obtain a plurality of channels of data, each channel of the data comprising initial data voltages corresponding to all data lines when a gate line in a row corresponding to the channel is turned on;

outputting a plurality of sets of comparison data according to the plurality of channels of data, each set of the comparison data comprising an actual data voltage on a data line when a gate line in a row immediately preceding a current row is turned on, and an initial data voltage on the same data line when the gate line in the current row is turned on;

looking up, based on each of the sets of comparison data, actual compensation data corresponding to the set of comparison data; and compensating for, based on the actual compensation data, the initial data voltage on a data line corresponding to the actual compensation data when the gate line in the current row is turned on to obtain an actual data voltage on the data line when the gate line in the current row is turned on, and storing the actual data voltages on all the data lines when the gate line in the current row is turned on, wherein the looking up, based on each of the sets of comparison data, the actual compensation data corresponding to the set of comparison data comprises:

looking up, based on each of the sets of comparison data, initial compensation data corresponding to the set of comparison data in a compensation initial data lookup table;

looking up, based on each of the sets of comparison data, a compensation gain corresponding to the set of comparison data in a gain lookup table; and calculating the actual compensation data based on the initial compensation data and the compensation gain, wherein the looking up, based on each of the sets of comparison data, the initial compensation data corresponding to the set of comparison data in the compensation initial data lookup table comprises:

determining an initial compensation data c corresponding to comparison data (a, b) according to the following formulas:

$$f(R1) = \frac{x\ (s+1)-a}{x\ (s+1)-xs} f(Q11) + \frac{a-xs}{x\ (s+1)-xs} f(Q21)$$

$$f(R2) = \frac{x\ (s+1)-a}{x\ (s+1)-xs} f(Q12) + \frac{a-xs}{x\ (s+1)-xs} f(Q22)$$

$$f(p) = \frac{y\ (r+1)-b}{y\ (r+1)-yr} f(R1) + \frac{b-yr}{y\ (r+1)-yr} f(R2)$$

where the comparison data (a, b) has a corresponding coordinate point in the compensation initial data lookup table, which is located in a region defined by coordinate points (xs, yr), (xs, y(r+1)), (x(s+1), yr), (x(s+1), y(r+1)); f(Q11) is a value corresponding to the coordinate point (xs, yr) in the compensation initial data lookup table, f(Q12) is a value corresponding to the coordinate point (xs, y(r+1)) in the compensation initial data lookup table, f(Q21) is a value corresponding to the coordinate point (x(s+1), yr) in the compensation initial data lookup table, and f(Q22) is a value corresponding to the coordinate point (x(s+1), y(r+1)) in the compensation initial data lookup table; and a value of f(p) is c.

13. The charge compensation method according to claim 12, further comprising:

acquiring a pixel structure type of the display device.

14. The charge compensation method according to claim 12, wherein the looking up, based on each of the sets of comparison data, the compensation gain corresponding to the set of comparison data in the gain lookup table comprises:

calculating a compensation gain corresponding to the comparison data (a, b) by using the following formulas:

$$f(G1) = \frac{e2 - e}{e2 - e1} f(G11) + \frac{e - e1}{e2 - e1} f(G21)$$

$$f(G2) = \frac{e2 - e}{e2 - e1} f(G12) + \frac{e - e1}{e2 - e1} f(G22)$$

$$f(G) = \frac{f2 - f}{f2 - f1} f(G1) + \frac{f - f1}{f2 - f1} f(G2)$$

where a pixel coordinate of a sub-pixel corresponding to the comparison data (a, b) is (e, f), which is located in a region defined by coordinate points (e1, f1), (e1, f2), (e2, f1), and (e2, f2); f(G11) is a compensation gain corresponding to the coordinate point (e1, f1), f(G12) is a compensation gain corresponding to the coordinate point (e1, f2), f(G21) is a compensation gain corresponding to the coordinate point (e2, f1), and f(G22) is a compensation gain corresponding to the coordinate point (e2, f2); and f(G) is g.

* * * * *